US011396088B2

(12) United States Patent
Murway et al.

(10) Patent No.: US 11,396,088 B2
(45) Date of Patent: Jul. 26, 2022

(54) CLEAT REMOVAL WRENCH

(71) Applicants: Edi C. Murway, Gardnerville, NV (US); Alan G. Tomasino, Garnerville, NV (US)

(72) Inventors: Edi C. Murway, Gardnerville, NV (US); Alan G. Tomasino, Garnerville, NV (US)

( * ) Notice: Subject to any disclaimer, the term of this patent is extended or adjusted under 35 U.S.C. 154(b) by 254 days.

(21) Appl. No.: 16/794,878

(22) Filed: Feb. 19, 2020

(65) Prior Publication Data

US 2021/0252676 A1 Aug. 19, 2021

(51) Int. Cl.
*B25B 13/50* (2006.01)
*B25B 27/14* (2006.01)

(52) U.S. Cl.
CPC ..... *B25B 13/50* (2013.01); *B25B 27/14* (2013.01)

(58) Field of Classification Search
CPC .... B25B 7/00; B25B 7/02; B25B 7/04; B25B 7/06; B25B 7/08; B25B 7/10; B25B 7/123; B25B 7/22; B25B 9/00; B25B 13/00; B25B 13/50; B25B 13/56; B25B 23/00; B25B 23/02; B25B 23/08; B25B 27/00; B25B 27/02; B25B 27/04; B25B 27/08; B25B 27/14; B25B 27/146; B25B 27/20; B25B 33/00; A43C 15/16; A43C 15/161; A43C 15/167; A43C 15/18; A43B 5/00; A43B 5/001
See application file for complete search history.

(56) References Cited

U.S. PATENT DOCUMENTS

| | | | | |
|---|---|---|---|---|
| 1,813,038 | A * | 7/1931 | Erne | B25B 7/02 81/13 |
| 2,881,648 | A | 4/1959 | Hottle | |
| 3,238,823 | A | 3/1966 | Snow | |
| 3,412,635 | A | 11/1968 | Chmielewski | |
| 3,902,206 | A * | 9/1975 | Naquin | H02G 1/1229 7/107 |
| 3,903,762 | A * | 9/1975 | Acrea | B25B 13/48 81/176.15 |
| 4,229,849 | A * | 10/1980 | Theiler, Sr. | B25B 7/22 7/107 |
| 4,262,562 | A | 4/1981 | MacNeill | |
| 5,014,379 | A | 5/1991 | Hull et al. | |
| 5,072,634 | A | 12/1991 | Ryder | |
| 5,284,072 | A | 2/1994 | Smith | |
| 5,497,523 | A | 3/1996 | Tarnoff | |
| 5,551,111 | A | 9/1996 | Murphy | |
| 5,611,519 | A * | 3/1997 | Garcia | B25B 7/02 254/22 |
| 5,864,078 | A * | 1/1999 | Koevering | G10H 1/0066 84/478 |
| 5,865,078 | A | 2/1999 | Langford | |

(Continued)

*Primary Examiner* — Robert J Scruggs
(74) *Attorney, Agent, or Firm* — Williams Intellectual Property; Benjamin F. Williams

(57) ABSTRACT

A cleat removal wrench is provided having a pair of cleat engagement members projecting arced, terminal edges to a plane subjacent relative to a pair of handle portions. The terminal edges are disposed to distribute force applied at the handle portions to the base or shank of a cleat to garner purchase at the cleat base or shank and enable application of torque and thereby more easily remove and replace cleats on sporting footwear.

14 Claims, 6 Drawing Sheets

(56) References Cited

U.S. PATENT DOCUMENTS

| | | | | |
|---|---|---|---|---|
| 5,887,496 | A * | 3/1999 | Pollard | B25B 13/50 81/461 |
| 6,012,357 | A * | 1/2000 | John | H02G 1/1214 30/90.1 |
| 6,053,078 | A | 4/2000 | Parker et al. | |
| 6,161,456 | A | 12/2000 | Langford | |
| 6,170,364 | B1 | 1/2001 | Johnson | |
| 6,256,855 | B1 * | 7/2001 | Schall | B25B 7/02 29/275 |
| 8,800,411 | B2 * | 8/2014 | Seemangal | B25F 1/006 81/420 |
| 9,701,004 | B2 * | 7/2017 | Hardinge | B25G 1/085 |
| 9,782,877 | B2 * | 10/2017 | Marquis | B25B 27/02 |
| 2005/0072026 | A1 | 4/2005 | Sink | |
| 2015/0189950 | A1 * | 7/2015 | Adams | A43B 5/00 12/142 R |

* cited by examiner

CLEAT REMOVAL WRENCH

BACKGROUND OF THE INVENTION

Good footwear is essential to high performance on the field. Sporting footwear often includes spiked cleats on the shoe sole to increase traction when running on ground surfaces and prevent slipping during gameplay. Due to their position on the sole of the shoe, the ground surfaces they are worn upon, and the forces they are subjected to during gameplay, cleats often become damaged and deformed with extended use, or by contact with hard surfaces, such as stone or concrete, for example. To allow for frequent is replacement, most cleats are releasably attachable to the shoe by a threaded shank that is screwed into a hole recessed into the shoe sole. Cleats are therefore replaceable as needed, without a player having to discard an entire shoe for want of better cleats.

However, as any sporting enthusiast knows, removal of cleats can be troublesome. Cleats are desirously tautly engaged into the shoe sole to prevent loss during gameplay. Tools are frequently employed to leverage torque and ensure maximized tautness of engagement into the shoe sole to prevent loosening or loss during gameplay. This makes removing the cleats difficult, especially after extended use and wear in the outdoors. Soil particles often accumulate around the cleat, and in between the cleat and the shoe sole, increasing friction when turning the shank or attempting to drive the cleat. Some soils can become hard when dried, and effectively cement the cleats in place. This difficulty is exacerbated by a general inability to gain purchase upon the cleat to effectuate the torque required to drive the cleat and loosen the embedded shank, due to the size and shape of the cleat's base, and due to deformation that frequently results rendering the base an irregular shape.

As a result, various tools are known in the art for removing cleats and replacing cleats on shoe soles. Some are engineered to a specific cleat, and shaped to seat around, upon, or into an aperture of, specific cleats. Each extends a lever arm to assist in applying torque to remove the cleat. However, problems with these designs persist: deformed cleats do not seat into specially shaped receptacles disposed upon specialized tools which are prone to slip when the tool is turned. Soil buildup around the base can further confound the purchase such tools seek to advantage requiring cleaning the shoe sole to an extent that may not be available immediately prior to gameplay.

What is needed is a cleat removal wrench that is engineered specifically to engage against a variety of cleat shapes, that leverages torque at a pair of curved terminal edges devised to seat against a cleat to gain purchase at the cleat base and enable manual removal and replacement of even deformed cleats in an expedient manner.

FIELD OF THE INVENTION

The present invention relates to a cleat removal wrench devised to apply torque to cleats in sporting footwear and enable more easy removal of the said cleats, even after extended use and wear. The present invention is configured to present curved terminal edges of each of a pair of cleat engagement members, projected subjacently from a pair of arms, to enable purchase against the base of cleats and increase torque to grip and drive the cleats and effectively remove them from the shoe sole, whether by turning to unscrew the cleat shank or to pull the cleat directly out of the shoe sole (as in some cleat designs). The design of the present invention enables use upon a variety of shaped and sized cleats, including studs (as used in rugby shoes, for example), pins (as used in golf shoes, for example), and spikes (as used in running shoes, for example), whether having round or polygonal shaped bases.

SUMMARY OF THE INVENTION

As used herein throughout, the term "cleat" includes any removable projection devised to be oriented from a shoe sole to increase traction when engaging in sporting activities. The term "enantiomorphic" is taken according to its ordinary meaning as "mirror-imaged."

The present cleat removal wrench has been devised to enable increased torque in removing the variety of shaped and sized cleats commonly employed upon sporting footwear. Such cleats are generally applied to increase traction during gameplay, to prevent slipping and sliding, and to facilitate the agility successful players naturally display in bypassing their opponents on the field. In use, such cleats can become embedded, encrusted, deformed, deteriorated and therefore generally difficult to replace when needed.

The present cleat removal wrench has been devised with novel structure that enables acquisition of purchase directly upon the base of a cleat to which it is applied, or to gain purchase at the shank sunk into the shoe sole, whereby removal of the said cleat is facilitated even where the cleat base is deformed, deteriorated, or rendered of an irregular shape following extended use. The present cleat removal wrench is therefore usable across a plurality of cleat designs.

The present cleat removal wrench, therefore, includes a pair of coplanar, laterally adjacent arms disposed bounding an interstitial space and pivotally connected at distal ends thereof. Along the length of the pair of arms, distally situated relative to a pair of handle portions, a pair of cleat engagement members is disposed. The pair of cleat engagement members is devised for clamping engagement against the base and/or shank of the targeted cleat, to increase pressure and therefore garner purchase at the cleat base and/or shank and apply increased torque to drive the cleat and effectuate removal of the cleat.

Each cleat engagement member is disposed to extend an arced terminal edge to a plane subjacent each of the pair of arms, said terminal edge presenting an acute curved extent devised to engage against a base and/or shaft of a cleat to which the tool is applied. The force applied to squeeze the handle portions of the wrench together is therefore distributed through the pair of arms, through the cleat engagement members, to the arced terminal edges, whereby pressure is increased thereat appropriate for garnering purchase against the cleat base and/or shank. Once purchase is achieved, the cleat removal wrench is devised to apply increased torque to the cleat to drive the cleat with relative ease and therefore effectuate removal of the cleat from a sporting shoe sole. Once a new cleat has been fitted to the now vacated hole, the new cleat may be tightened into place by use of the same cleat removal wrench applied in like capacity, with the exception of the direction of rotation.

Each cleat engagement member includes a sloped member disposed projected along a negative slope into the interstitial space between the pair of arms. In a preferred embodiment, each said sloped member forms a section of an inverted, truncated cone. When the arms are moved to a closed position, the terminal edge of each of the cleat engagement members is brought to close proximity, creating a generally circular aperture therebetween, bounded by an acute linear extent. Each terminal edge may thus be brought to close proximity whereby the circular aperture is positionable approximal and surrounding a cleat, either at its base or underlying its base at the shank head at the juncture with the shoe sole, whereby the terminal edges are engaged against the base or shank of the cleat. Thus, even deformed, degraded, and hard-to-remove cleats are readily grasped by the wrench and torque thereafter readily applied to drive the cleat and effectuate removal of the cleat, or to tighten newly installed cleats, as desired.

Each cleat engagement member includes and a top surface that is at least partially concave between a first lateral edge and a second lateral edge, and from an apical portion down to the terminal edge. The concavity thus bounded by each said cleat engagement member is therefore seatable around a cleat upon a shoe sole, accommodating the cleat therein, and enabling approximation of the terminal edges to grip against the base of the cleat and, in some embodiments, directly to the shank of the cleat at its juncture with the shoe sole underlying the cleat base.

The pair of arms is therefore wieldable at a respective handle portion between an open position and a closed position to situate each curved terminal edge in taut contact against a cleat on an existing sporting footwear, to apply pressure and garner purchase at the cleat base or shank, whereby said cleat is removable when each handle portion is thence squeezed toward the closed position and each curved terminal edge is engaged against the cleat and thence rotated counterclockwise.

In a preferred embodiment set forth and depicted herein, the pair of arms include a first arm and a second arm. Each arm includes a longitudinal axis, a body potion disposed along the longitudinal axis, a handle portion, and a distal end deflected off the longitudinal axis to accommodate pivotal connection with the other said arm. The second arm is generally enantiomorphic (that is, mirror-imaged) with respect to the first arm but is configured to distally seat under the first arm at the distal end. The distal end of each of the first and second arms is deflected off the longitudinal axis appropriately to accommodate pivotal connection thereat while enabling each of the handle portions, arms, and cleat engagement members to remain in parallel configuration.

A lever arm distance from the cleat engagement members to the ends of the handle portions applies torque to a cleat when engaged at the terminal edges, and the terminal edges increase pressure applied through the cleat engagement members from the pair of arms to increase purchase upon the cleat base or shank, as case may be, to readily facilitate removal and replacement of cleats.

In at least one embodiment set forth herein, the cleat removal wrench includes a spring member between the distal ends of each of the pair of arms. The spring member is devised to assist in wielding the device by a user and compresses when the pair of arms is moved to the closed position. Release of the pair of arms from the closed position is thereby facilitated by action of the spring member. The spring member thus maintains the wrench in the open position, until squeezed to the closed position by a user, whereby application of the wrench around a targeted cleat is facilitated without a user necessarily having to first position the wrench in the open position.

In at least one embodiment contemplated herein, each terminal edge is feathered upon the under surface in a plane parallel with the longitudinal axis of each of the pair of arms. This feathered, horizontal portion enables seating of the cleat engagement member flush to the shoe sole and orients the terminal edge acutely for contact with the cleat, increasing pressure at the terminal edge. In some embodiments contemplated herein, each terminal edge may also be serrated, having a plurality of teeth oriented upon the terminal edge for increase traction when engaged against the cleat base or shank.

Thus, has been broadly outlined the more important features of the present cleat removal wrench so that the detailed description thereof that follows may be better understood and in order that the present contribution to the art may be better appreciated.

Objects of the present cleat removal wrench, along with various novel features that characterize the invention are particularly pointed out in the claims forming a part of this disclosure. For better understanding of the cleat removal wrench, its operating advantages and specific objects attained by its uses, refer to the accompanying drawings and description.

BRIEF DESCRIPTION OF THE DRAWINGS FIGURES

DETAILED DESCRIPTION OF THE DRAWINGS

Figure 1:
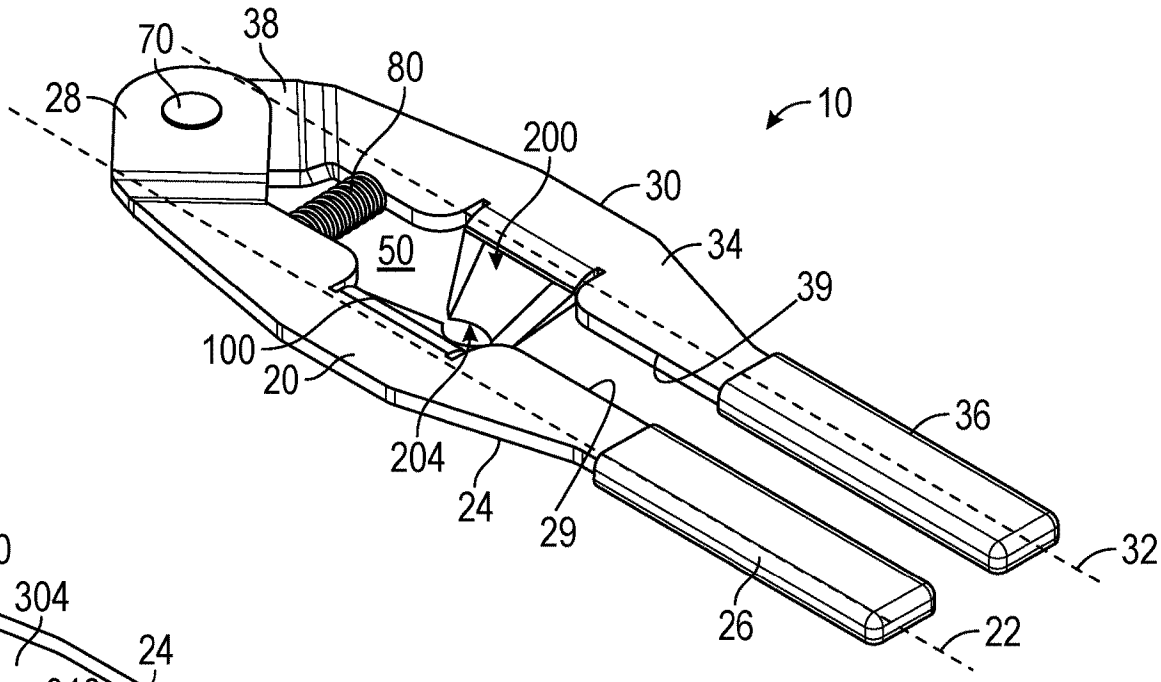
FIG. 1 is an isometric top view of an example embodiment.

With reference now to the drawings, and in particular FIGS. 1 through 9 thereof, example of the instant cleat removal wrench employing the principles and concepts of the present cleat removal wrench and generally designated by the reference number 10 will be described.

Referring to FIGS. 1 through 9 a preferred embodiment of the present cleat removal wrench 10 is illustrated.

The cleat removal wrench 10 includes a pair of coplanar, laterally adjacent arms 20, 30 having inner edges 29, 39, bounding an interstitial space 50. The pair of arms includes a first arm 20 and a second arm 30 pivotally connected at distal ends 28, 38 thereof. The first arm 20 includes longitudinal axis 22, body potion 24 disposed along the longitudinal axis 22, handle portion 26, and distal end 28 deflected off the longitudinal axis 22 toward the second arm 30 and configured to accommodate pivotal connection with the second arm 30. Cleat engagement member 100 is disposed upon the first arm 20 projected radially into the interstitial space 50 between the first and second arms 20, 30. The cleat engagement member 100 includes sloped member 102, disposed edgewise upon the body portion 24 and projected along a negative slope into the interstitial space 50 to a position subjacent the longitudinal axis 22, and curved terminal edge 104 disposed endwise upon the sloped member 102. The curved terminal edge 104 is projected to a position subjacent a lowermost surface 25, 35 of each of the pair of arms 20, 30 and is configured to engage circumferentially around the basal portion of a cleat 500 when the pair of arms 20, 30 are squeezed together, as will be described hereinbelow.

The second arm 30 is generally enantiomorphic with respect to the first arm 20 but is configured to distally seat under the first arm 20 at the distal end 38. The second arm 30 likewise includes longitudinal axis 32, body potion 34 disposed along the longitudinal axis 32, handle portion 36, distal end 38 deflected off the longitudinal axis 32 toward the first arm 20, and cleat engagement member 200. Cleat engagement member 200 likewise includes sloped member 202 and curved terminal edge 204 devised enantiomorphically with respect to cleat engagement member 100. Distal end 38 is configured to accommodate pivotal connection with the first arm 20 while maintaining handle portion 36 and body portion 34 of the second arm 30 coplanar with handle portion 26 and body portion 24 of the first arm 20. In the example embodiment depicted in the accompanying figures, distal end 38 of the second arm 30 is deflected downwardly off longitudinal axis 32 and distal end 28 of the first arm 20 is deflected a corresponding distance upwardly off longitudinal axis 22, enabling pivotal connection of the distal ends 28, 38 while maintaining coplanar relation of each of the handle portions 26, 36 and the remainder of the arms 20, 30 to orient cleat engagement members 100, 200 side-by-side in parallel relation whereby the terminal edges 104, 204 are usable in conjunction to garner purchase upon a targeted cleat 500.

Cleat engagement member 200 is disposed projected from the second arm 30, enantiomorphic with respect to the cleat engagement member 100 of the first arm 20. A sloped member 202 is disposed edgewise upon body portion 34 and projected along a negative slope into the interstitial space 50 to culminate at curved terminal edge 204 disposed endwise upon the sloped member 202. The curved terminal edge 204 is projected to a position subjacent the pair of arms 20, 30. The cleat engagement members 100, 200 of each of the first and second arms may conjunct each other at ends 106, 206 of each said curved terminal edge 104, 204 when the wrench 10 is moved to a closed position. The curved terminal edges 104, 204 are configured to engage circumferentially against the base or basal portion of a cleat 500 installed to a sporting footwear to exact purchase thereagainst and enable application of torque when the wrench 10 is rotated to effectively remove the cleat 500 from the shoe sole 550, even when the cleat 500 is damaged or deformed.

Discussing now particularly the figures, FIG. 1 illustrates an isometric top view of an example embodiment of the present cleat removal wrench 10. The first arm 20 and the second arm 30 occupy parallel positions in a like plane. Distal ends 28, 38 are pivotally joined at pivot point 70. Handle portions 26, 36 enable comfort in use when grasping in the hand and may include a rubberlike or polymeric covering, thermally insulated, and suited to increase traction in the hand and comfort when wielding, even during cold days on the field. Spring member 80 is disposed proximal distal ends 28, 38 to assist restoration of the wrench 10 to the open position once closed whereby the wrench 10 defaults to the open position when unhanded.

Figure 2:
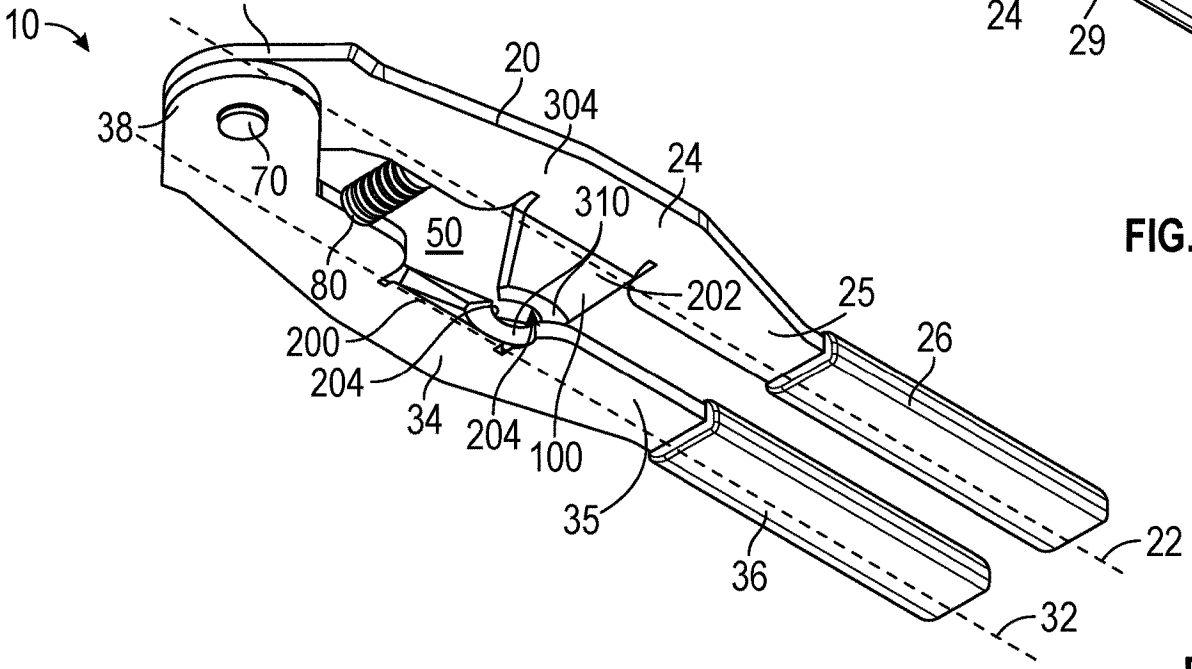
FIG. 2 is an isometric bottom view of an example embodiment.

FIG. 2 illustrates an isometric bottom view of an example embodiment of the present cleat removal wrench 10. In this embodiment, as shown in FIG. 1, distal end 28 of the first arm 20 is deflected upwards a distance approximately half the thickness of the body portion 24 and distal end 38 of the second arm 30 is deflected downwards approximately half the thickness of the body portion 34 whereby each of the first and second arm body portions 24, 34 and handle portions 26, 36 are thereby aligned co-planarly.

The cleat engagement members 100, 200 are disposed to project curved terminal edges 104, 204 subjacent to the handle portions 26, 36, at a distance h underlying the respective arms 20, 30 approximately greater than the height of a typical cleat 500 when seated into a corresponding footwear 550. Thus, each cleat engagement member 100, 200 may be engaged against the base of the cleat 500 while enabling rotation of the handle portions 26, 36 without abutting up against other cleats as may otherwise confound the turning of the wrench 10 were the terminal edges 104, 204 of the cleat engagement members 100, 200 disposed more adjacent to the handle portions of the arms 20, 30.

Figure 3:
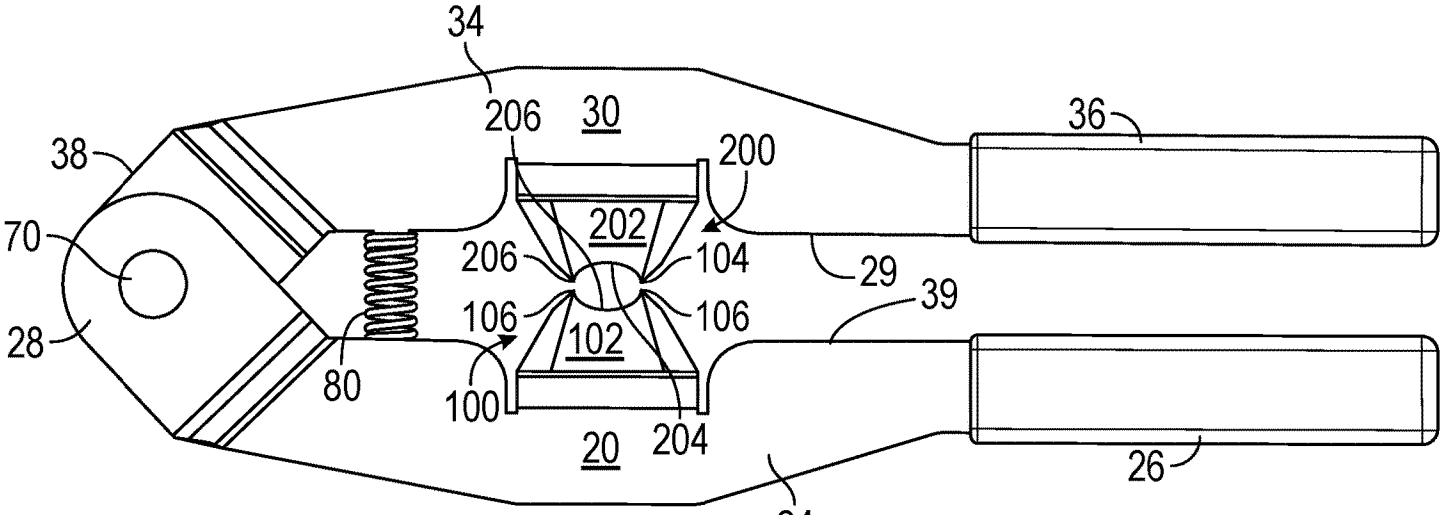
FIG. 3 is a top elevation view of an example embodiment.
Figure 4:
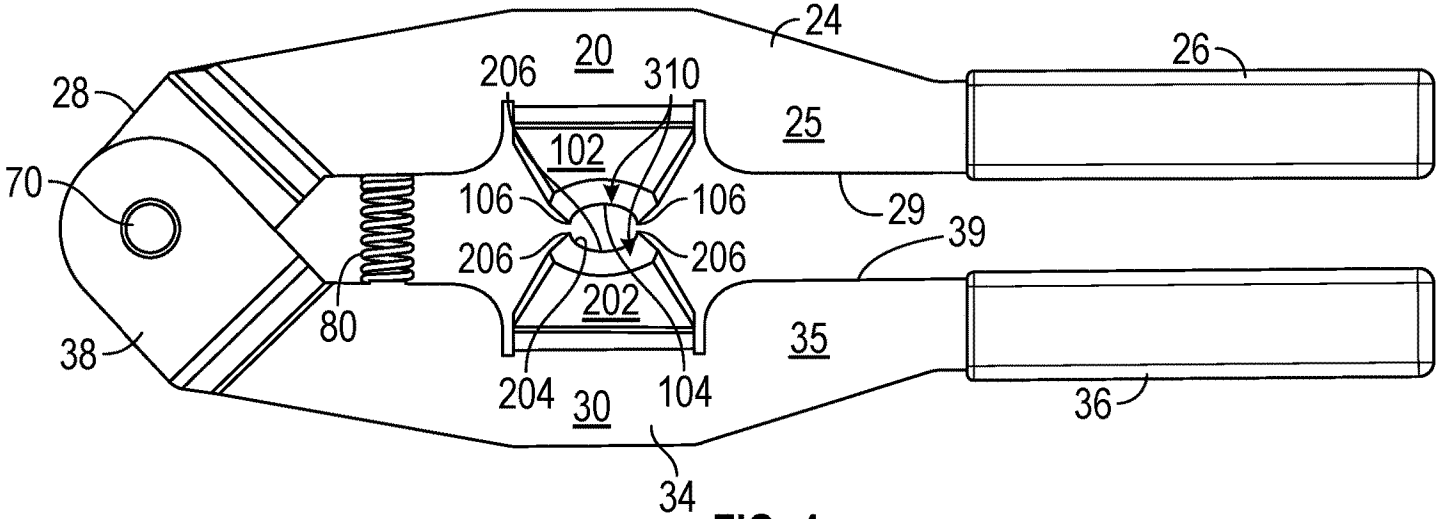
FIG. 4 is a bottom elevation view of an example embodiment.

FIG. 3 illustrates a top elevation view of an example embodiment and FIG. 4 illustrates a bottom elevation view of an example embodiment of the cleat removal wrench 10. As shown, each cleat engagement member 100, 200 includes apical portion 300, upper surface 302, under surface 304, first lateral edge 306, and second lateral edge 308. In this example embodiment, upper surface 302 is at least partially concave, rendering the cleat removal members 100, 200 as frustoconical sections. As shown, each terminal edge 104, 204 is feathered upon the under surface 302, providing a horizontal section 310 adapted for approximal contact with the shoe sole 550 upon which the wrench 10 is situated in removing the cleat 500 therefrom.

Figure 5:
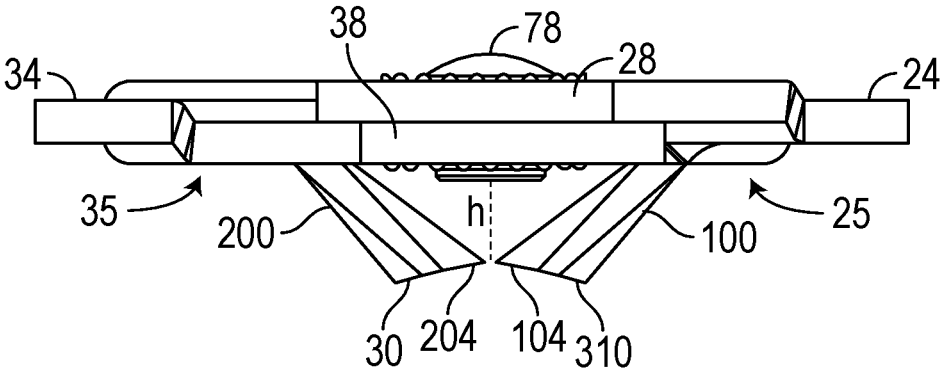
FIG. 5 is a front elevation view of an example embodiment.
Figure 6:
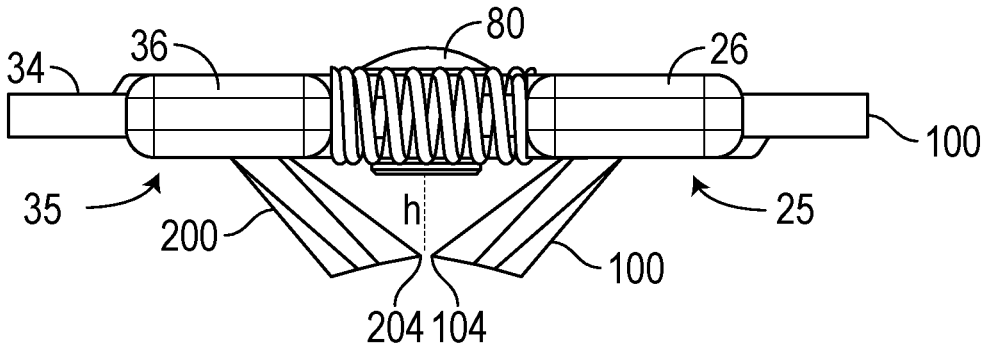
FIG. 6 is a rear elevation view of an example embodiment.

The distance sloped members 102, 202 project subjacent the respective first and second arms 20, 30 is best shown in FIGS. 5 and 6. Depth h corresponds with a length greater than the height of typical cleats when inserted into the shoe sole, whereby rotation of the wrench 10 when engaged to a cleat 500 base is not impeded by other cleats upon the shoe sole. (See for example FIG. 9.)

Figure 7:
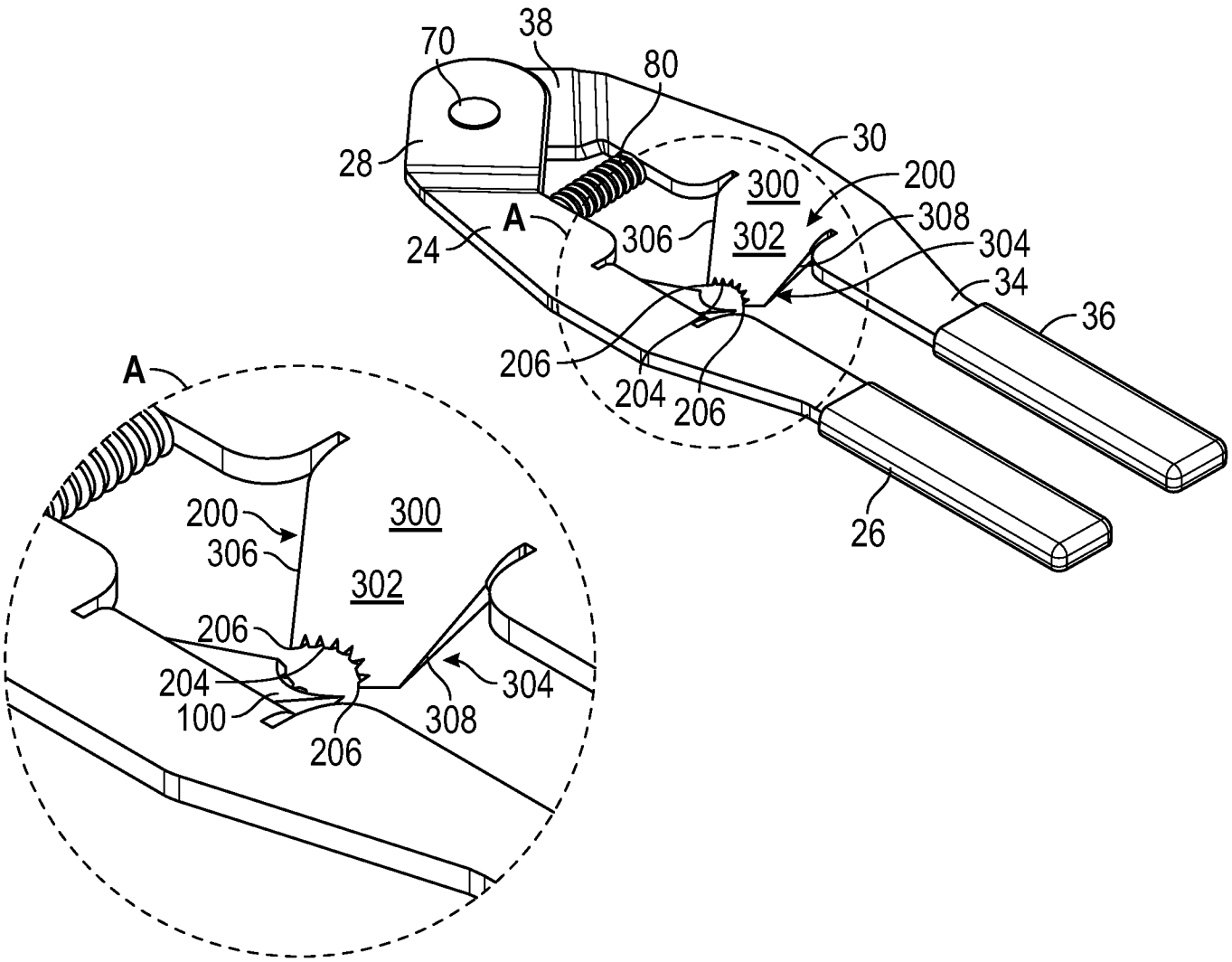
FIG. 7 is a detail view of a top isometric view of an example embodiment of a pair of cleat engagement members.
Figure 8:
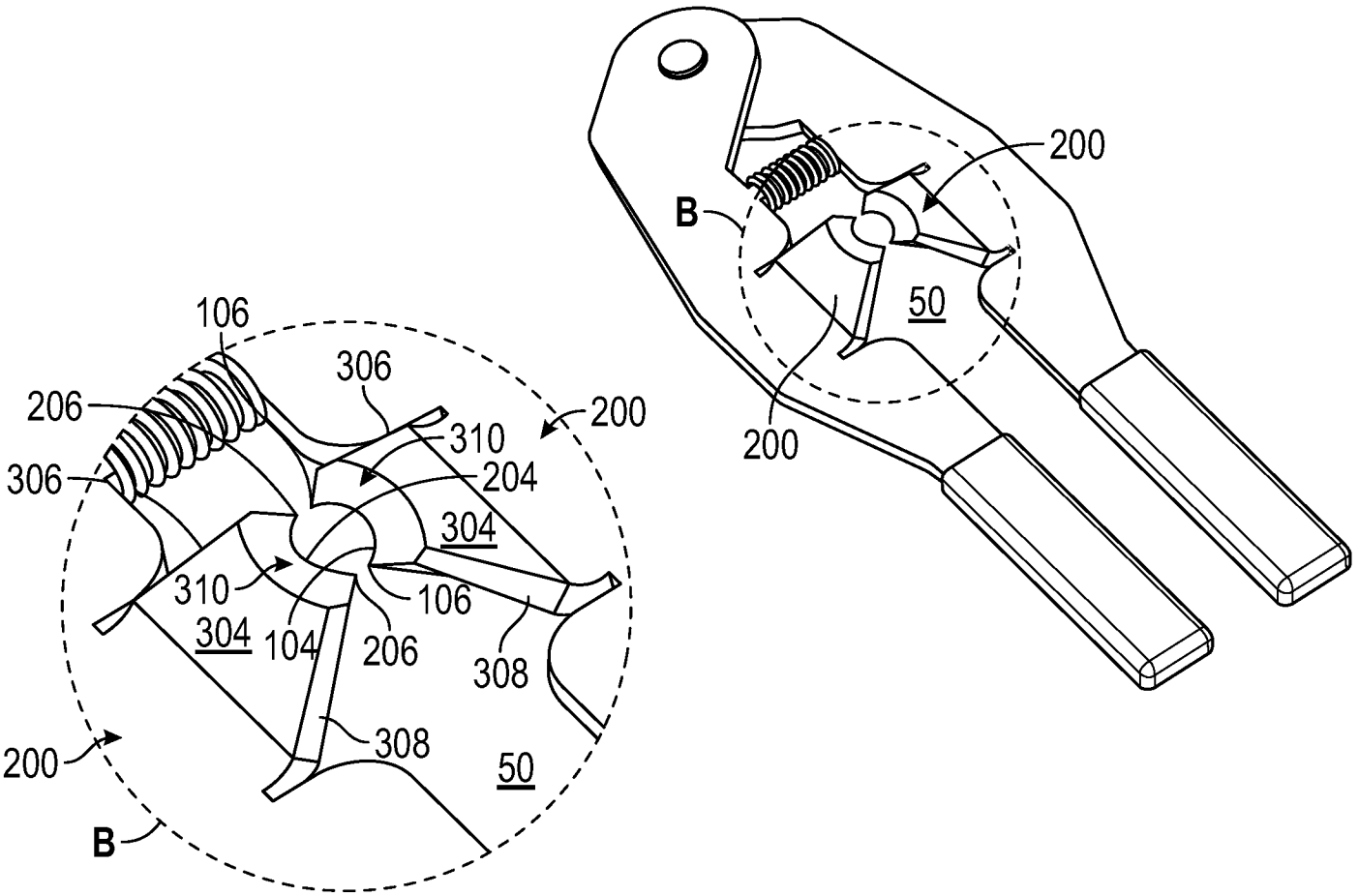
FIG. 8 is a detail view of a bottom isometric view of an example embodiment of a pair of cleat engagement members.

FIGS. 7 and 8 show detail views of the cleat engagement members 100, 200. In some embodiments, the curved terminal edge 104, 204 of each of the cleat engagement members may be serrated, toothed, or include other features or structures devised to increase traction and/or pressure against a cleat base or shank when the said curved terminal edge 104, 204 is engaged against the cleat base or, in some cases, shank. As best represented in FIGS. 7 and 8, in some embodiments the curved terminal edge 104, 204 may be seatable between the cleat 500 base and the shoe sole 550 by action of the horizontal section 310 on the under surface 304 of each corresponding sloped member 102, 202, to drive the cleat and to gain purchase directly at the shank of the cleat.

Figure 9:
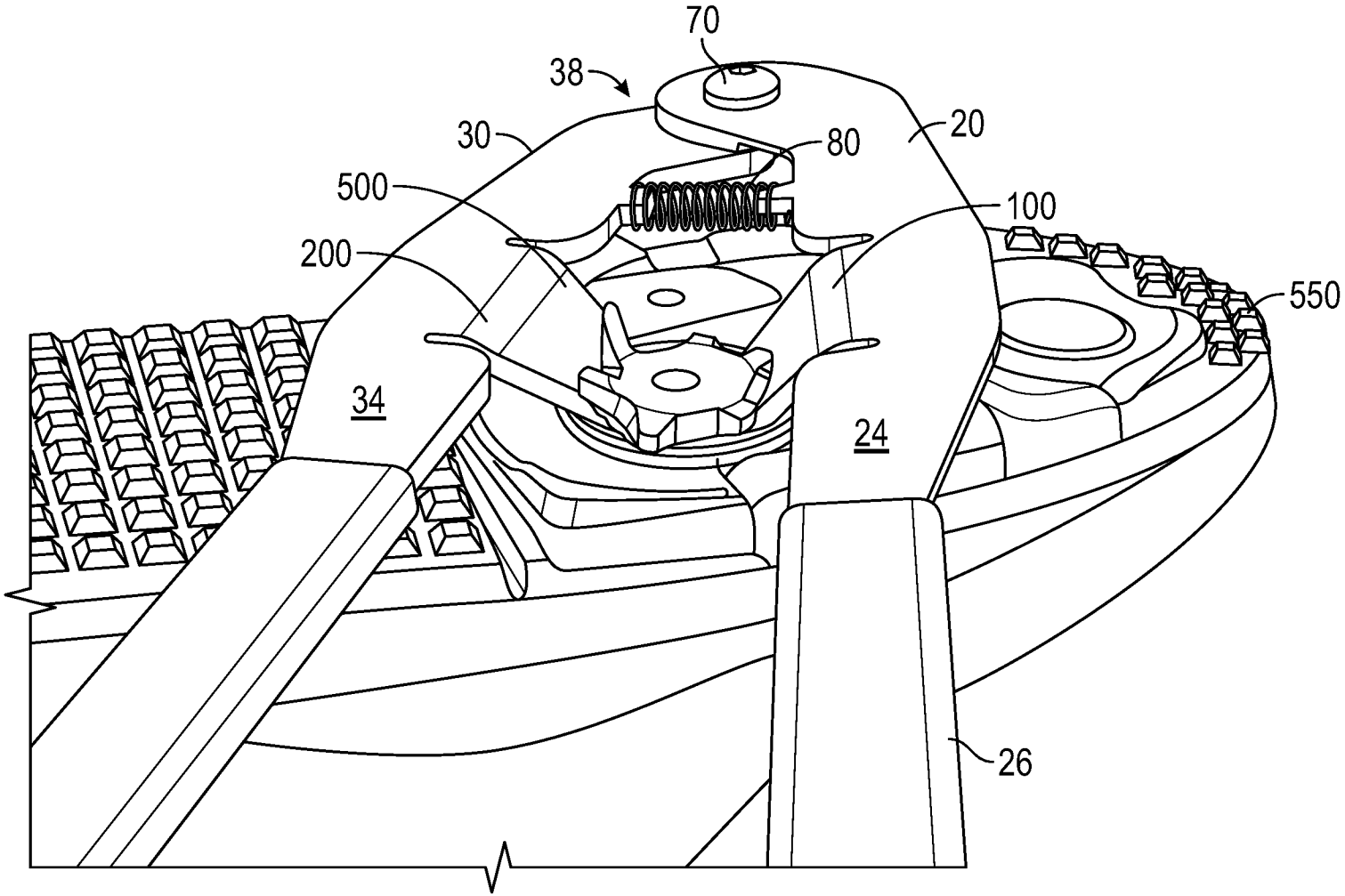
FIG. 9 is an in-use view of an example embodiment engaged to an existing cleat.

FIG. 9 illustrates an in-use view with the cleat removal wrench 10 engaged against a cleat 500. Cleat engagement members 100, 200 have been secured to the cleat 500 base to garner purchase thereat. Rotation of the wrench 10 thence effects rotation of the cleat 500 for removal, by distributing the force applied in bringing the handle portions 26, 36 to the closed position directly to the cleat 500 base, or shank as case may be, and increasing the pressure there applied, while increasing torque along the lever arm distance applied by the handle portions 26, 36.

What is claimed is:

1. A cleat removal wrench comprising:

a pair of coplanar, laterally adjacent arms, said pair of arms each having an inner edge bounding an interstitial space, said pair of arms pivotally connected at a distal end thereof, each of said pair of arms comprising:

a handle portion;

a cleat engagement member comprising:

a sloped member disposed projected radially along a negative slope into the interstitial space; and a curved terminal edge disposed endwise upon the sloped member, said curved terminal edge projected to a position subjacent a lowermost surface of the pair of arms;

wherein the pair of arms is wieldable at the respective handle portion between an open position and a closed position to situate each curved terminal edge against a cleat on an existing sporting footwear whereby said cleat is removable when each handle portion is thence squeezed toward the closed position and each curved terminal edge is engaged against the cleat and rotated counterclockwise.

2. The cleat removal wrench of claim 1 wherein each sloped member further comprises:

an apical portion;

an upper surface;

an under surface;

a first lateral edge; and a second lateral edge;

wherein the upper surface is at least partially concave between the first lateral edge and the second lateral edge, and from the apical portion to the terminal edge.

3. The cleat removal wrench of claim 2 wherein each sloped member forms a section of an inverted, truncated cone and each terminal edge is feathered upon the under surface.

4. The cleat removal wrench of claim 3 wherein the pair of arms further comprises a spring member disposed between the distal ends of each of the pair of arms, said spring member compressible when the pair of arms is moved to the closed position, whereby release of the pair of arms from the closed position is facilitated by action of the spring member and the wrench defaults to the open position when unhanded.

5. The cleat removal wrench of claim 4 wherein each terminal edge is feathered upon the under surface in a plane parallel with a longitudinal axis of each of the pair of arms.

6. The cleat removal wrench of claim 5 wherein each terminal edge is serrated.

7. The cleat removal wrench of claim 1 wherein the pair of arms further comprises a spring member disposed between the distal ends of each of the pair of arms, said spring member compressible when each of the pair of arms is moved to the closed position, whereby release of the pair of arms from the closed position is facilitated by action of the spring member and the wrench defaults to the open position when unhanded.

8. A cleat removal wrench comprising a pair of coplanar, laterally adjacent arms, each of said pair of arms having an inner edge bounding an interstitial space, said pair of arms comprising a first arm and a second arm:

said first arm comprising;

a longitudinal axis;

a body potion disposed along the longitudinal axis;

a handle portion;

a distal end deflected off the longitudinal axis toward the second arm and configured to accommodate pivotal connection with the second arm;

a cleat engagement member comprising:

a sloped member disposed edgewise upon the inner edge of the body portion and projected radially along a negative slope into the interstitial space;

a curved terminal edge disposed endwise upon the sloped member, said curved terminal edge projected to a position subjacent a lowermost surface of the pair of arms;

said second arm, generally enantiomorphic with respect to the first arm but configured to distally seat under the first arm at the distal end, said second arm comprising:

a longitudinal axis;

a body potion disposed along the longitudinal axis;

a handle portion;

a distal end deflected off the longitudinal axis toward the first arm, said distal end configured to accommodate pivotal connection with the first arm while maintaining the handle portion and body of the second arm coplanar with the handle portion and body portion of the first arm;

a cleat engagement member comprising:

a sloped member disposed edgewise upon the inner edge of the body portion and projected radially along a negative slope into the interstitial space; and a curved terminal edge disposed endwise upon the sloped member, said curved terminal edge projected to a position subjacent a lowermost surface of the pair of arms;

wherein the pair of arms is wieldable at the respective handle portion between an open position and a closed position to situate each curved terminal edge against a cleat on an existing sporting footwear whereby said cleat is removable when each handle portion is thence squeezed toward the closed position to engage each curved terminal edge against the cleat and rotated counterclockwise.

9. The cleat removal wrench of claim 8 wherein the distal end of the first arm is deflected upwards a distance approximately half the thickness of the body portion and wherein the distal end of the second arm is deflected downwards approximately half the thickness of the body portion whereby each of the first and second arm body portions and handle portions are thereby aligned coplanar despite the overlap of the said distal ends.

10. The cleat removal wrench of claim 9 wherein each sloped member further comprises:

an apical portion;

an upper surface;

an under surface;

a first lateral edge; and a second lateral edge;

wherein the upper surface is at least partially concave between the first lateral edge and the second lateral edge, and from the apical portion to the terminal edge.

11. The cleat removal wrench of claim 10 wherein each sloped member forms a section of an inverted, truncated cone.

12. The cleat removal wrench of claim 11 wherein the pair of arms further comprises a spring member disposed between the distal ends of each of the pair of arms, said spring member compressible when the pair of arms is moved to the closed position, whereby release of the pair of arms from the closed position is facilitated by action of the spring member and the wrench defaults to the open position when unhanded.

13. The cleat removal wrench of claim 12 wherein each terminal edge is feathered upon the under surface in a plane parallel with the longitudinal axis of each of the pair of arms.

14. The cleat removal wrench of claim 13 wherein each terminal edge is serrated.

* * * * *